US009375072B2

(12) United States Patent
Drugeon et al.

(10) Patent No.: US 9,375,072 B2
(45) Date of Patent: Jun. 28, 2016

(54) DEVICE FOR PACKAGING A COSMETIC PRODUCT

(75) Inventors: Lionel Drugeon, La Garenne Colombes (FR); Jean-François Delage, Clamart (FR); Jean-Marc Lebrand, Pantin (FR)

(73) Assignee: L'OREAL, Paris (FR)

( * ) Notice: Subject to any disclaimer, the term of this patent is extended or adjusted under 35 U.S.C. 154(b) by 192 days.

(21) Appl. No.: 13/992,423

(22) PCT Filed: Dec. 1, 2011

(86) PCT No.: PCT/EP2011/071560

§ 371 (c)(1), (2), (4) Date: Sep. 5, 2013

(87) PCT Pub. No.: WO2012/076402

PCT Pub. Date: Jun. 14, 2012

(65) Prior Publication Data

US 2013/0343800 A1 Dec. 26, 2013

Related U.S. Application Data

(60) Provisional application No. 61/423,806, filed on Dec. 16, 2010.

(30) Foreign Application Priority Data

Dec. 9, 2010 (FR) ..... 10 60304

(51) Int. Cl.

| | |
|---|---|
| ***A46B 11/00*** | (2006.01) |
| ***A45D 40/26*** | (2006.01) |
| ***A45D 40/00*** | (2006.01) |

(52) U.S. Cl.

CPC ..... *A45D 40/26* (2013.01); *A45D 40/0068* (2013.01); *A45D 40/265* (2013.01); *A45D 2200/051* (2013.01)

(58) Field of Classification Search

CPC ..... A45D 40/10; A45D 40/264
USPC ..... 401/127, 126
See application file for complete search history.

(56) References Cited

U.S. PATENT DOCUMENTS 7,118,298 B2 * 10/2006 Tsutsumi ..... 401/129
7,503,718 B2 * 3/2009 Hamada ..... 401/127

(Continued)

FOREIGN PATENT DOCUMENTS

EP 1 389 588 2/2004
EP 1 721 543 11/2006

(Continued)

OTHER PUBLICATIONS

International Search Report for corresponding International Patent Application No. PCT/EP2011/071560, dated Mar. 20, 2012.

(Continued)

*Primary Examiner* — Jennifer C Chiang
(74) *Attorney, Agent, or Firm* — The Marbury Law Group, PLLC

(57) ABSTRACT

A device for packaging a cosmetic product, comprising a container having an opening defined by a neck of the container, a cap for closing the container, a closing-off element for the opening, connected to the cap, a spring member located between the cap and the closing-off element, a seal able to engage with the closing-off element and the neck of the container, and a mechanism for locking the cap on the container in a locked position.

The locking mechanism comprises a retaining means and a means for actuating the retaining means in order to inactivate the retaining means so as to enable the cap to be moved from its locked position into an unlocked position in which the cap can be separated freely from the container.

15 Claims, 6 Drawing Sheets

(56) References Cited

U.S. PATENT DOCUMENTS

| | | | | |
|---|---|---|---|---|
| 7,841,794 | B2 | 11/2010 | Salciarini et al. | |
| 8,353,636 | B2 | 1/2013 | Drugeon et al. | |
| 8,998,521 | B2 * | 4/2015 | Weigel | 401/126 |
| 2012/0039659 | A1 | 2/2012 | Sanchez | |
| 2014/0147188 | A1 * | 5/2014 | Lefol | 401/121 |

FOREIGN PATENT DOCUMENTS

| | | |
|---|---|---|
| EP | 1 800 561 | 6/2007 |
| EP | 2 220 960 | 8/2010 |
| FR | 2 932 067 | 12/2009 |
| JP | 59-83391 A | 5/1984 |
| JP | 61 019539 | 2/1986 |
| JP | 61-36809 U | 3/1986 |
| WO | 2010/106235 | 9/2010 |
| WO | 2012/076403 | 6/2012 |

OTHER PUBLICATIONS

International Search Report for International Patent Application No. PCT/EP2011/071563, dated Mar. 20, 2012.

Japanese Office Action for copending JP Application No. 2013-542469, mailed Aug. 3, 2015.

* cited by examiner

DEVICE FOR PACKAGING A COSMETIC PRODUCT

This is a national stage application of PCT/EP2011/071560, filed internationally on Dec. 1, 2011, which claims priority to U.S. Provisional Application No. 61/423,806, filed on Dec. 16, 2010, as well as French Application FR 1060304, filed on Dec. 9, 2010, the entire contents each of which is incorporated by reference herein.

The present invention relates to a device for packaging a cosmetic product.

The invention relates more particularly to a device for packaging a cosmetic product provided with an opening mechanism having an actuating means.

The expression "cosmetic product" is understood to mean any composition as defined in Council Directive 93/35/EEC of 14 Jun. 1993.

A cosmetic product is generally packaged in a container closed by a cap screwed onto this container. Thus, pots that contain for example a care cream and have a closing lid screwed onto the pot are known. Also known are packaging devices that comprise a container and a cap, comprising an applicator fixed to the cap and extending into the container, the cap thus serving as a member for holding the applicator. This is the case particularly for mascara.

A drawback with this type of packaging is that the user needs to use both hands, such that the container is held in one hand and the cap is unscrewed with the other hand. This can be a problem for disabled persons or persons whose motor functions are impaired, particularly on account of a condition such as arthritis, for example.

In addition, the screw closure imposes a circular shape on the parts to be joined together, thereby constraining the design and/or limiting the possibilities of developing these devices.

Finally, this type of packaging device is rendered impermeable by seal compression along the movement axis of the cap with respect to the container, and this impermeability depends on the screwing force. Thus, during unscrewing, impermeability is no longer guaranteed.

Document FR2932067 proposes a device comprising a container for a cosmetic product and a closing stopper that engages on the container by screwing. The closing stopper is equipped with a movable applicator that is acted on axially by a spring means housed in the stopper such that a conical closing-off element comes into contact with a likewise conical seal fitted on the container.

However, the impermeability provided by the pressure force at the point of contact between the closing-off element and the seal varies depending on the movement of the stopper with respect to the container and is no longer guaranteed when the stopper is in the unlocked position.

In addition, in order to open this device, the user needs to use both hands, such that the container is held in one hand and the cap is unscrewed with the other hand.

Document WO2010106235 proposes a device comprising a container for packaging a cosmetic product surrounded by a protective element. The opening in the container is closed by a closing-off element carrying an applicator. The protective element comprises a means for retaining the container and closing-off member assembly in relation to the protective element. A means for actuating the retaining means inactivates the retaining means in order to detach the container and closing-off member assembly from the protective element. This assembly is moved with respect to the protective element by means of a return element positioned between the container and the protective element. The return element also makes it possible to maintain sufficient impermeability when the device is in the locked position.

This device is relatively complex and necessitates the use of a protective element that makes it longer and more expensive to assemble the device.

In addition, in this device, the closing-off member also serves as a holding member. The holding member can thus be contaminated, causing the user's fingers to be soiled.

Finally, when the device is in the unlocked position, impermeability between the closing-off member and the container is no longer ensured as well as it is in the locked position, since the axial force of the return means is no longer exerted between these two elements, and this can lead to spillages of product if the device is unlocked accidentally.

The object of the present invention is thus to provide an improved device for packaging a cosmetic product in order to alleviate the abovementioned drawbacks.

To this end, the invention provides a packaging device, comprising a container having an opening defined by a neck of the container, a cap for closing the container, a closing-off element for the opening, connected to the cap, a spring member located between the cap and the closing-off element, a seal able to engage with the closing-off element and the neck of the container, and a mechanism for locking the cap on the container in a locked position.

According to the invention, the locking mechanism comprises a retaining means and a means for actuating the retaining means in order to inactivate the retaining means so as to enable the cap to be moved from its locked position into an unlocked position in which the cap can be separated freely from the container.

The invention advantageously provides a simple packaging device comprising an unlocking mechanism which can be easily activated.

According to further features of the invention, the cap may be moved from its locked position to its unlocked position by the cap moving purely in translation with respect to the container, thereby making it possible for packaging elements having a non-circular cross section to be used.

The closing-off element may be fixed with respect to the container during the movement of the cap from its locked position to its unlocked position.

This feature makes it possible advantageously to ensure impermeability even when the cap is in the unlocked position.

The seal may be in contact with the closing-off element and the neck of the container in the unlocked position of the cap.

The contact between the seal and the neck of the container and/or between the seal and the closing-off element may be radial with respect to the movement axis of the cap from its locked position to its unlocked position.

The seal may be mounted in a fixed manner on the closing-off element.

The closing-off element may comprise an applicator which extends from the cap into the container, it then being possible for the seal to be an applicator wiper mounted in a fixed manner on the neck of the container.

An insert may be fixed in the cap and the closing-off element may then be mounted in a sliding manner in this insert.

The insert may comprise a catching means that engages with the retaining means of the locking mechanism.

The insert may comprise a means for limiting the movement path of the cap with respect to the closing-off element while the cap passes from the locked position to the unlocked position.

The travel-limiting means may be formed by the catching means of the insert that engages with a stop of the closing-off member.

The travel-limiting means may also be a window in the insert that engages with a protrusion on the closing-off element.

The locking mechanism may comprise a hoop fixed around the neck of the container and an elastic ring positioned between the hoop and the neck of the container.

The retaining means and the actuating means may be supported by the elastic ring, and the retaining means and the actuating means may project from the outside of the hoop.

The neck of the container may comprise a narrowing in order to enable the deformation of the ring, which is advantageously greater than on a neck without a narrowing.

The invention will be understood better from reading the following description of non-limiting examples of the implementation thereof with reference to the appended drawings, in which.

Figure 1:
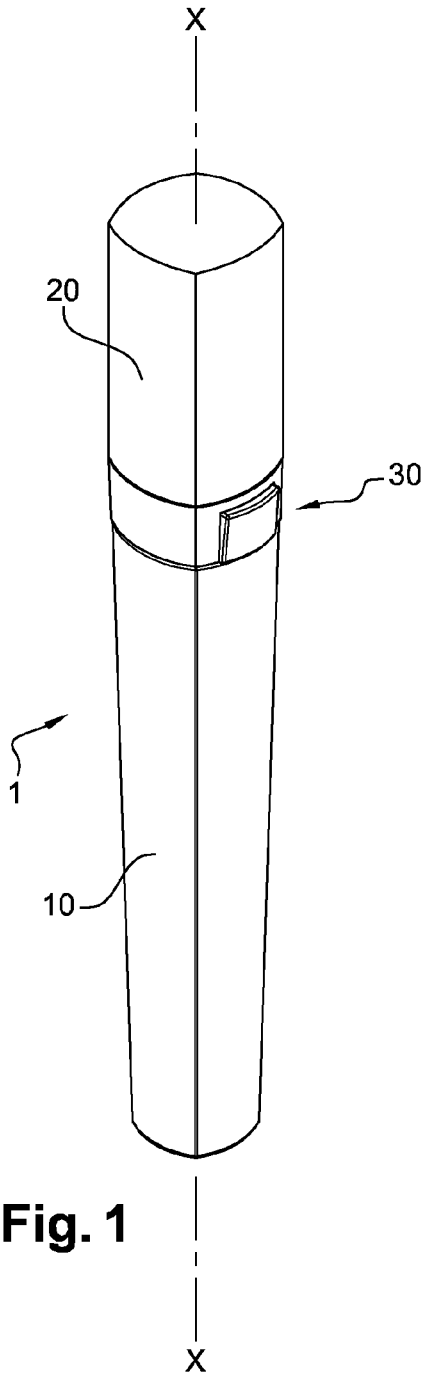
FIG. 1 shows an example of a packaging device according to the invention.
Figure 2:
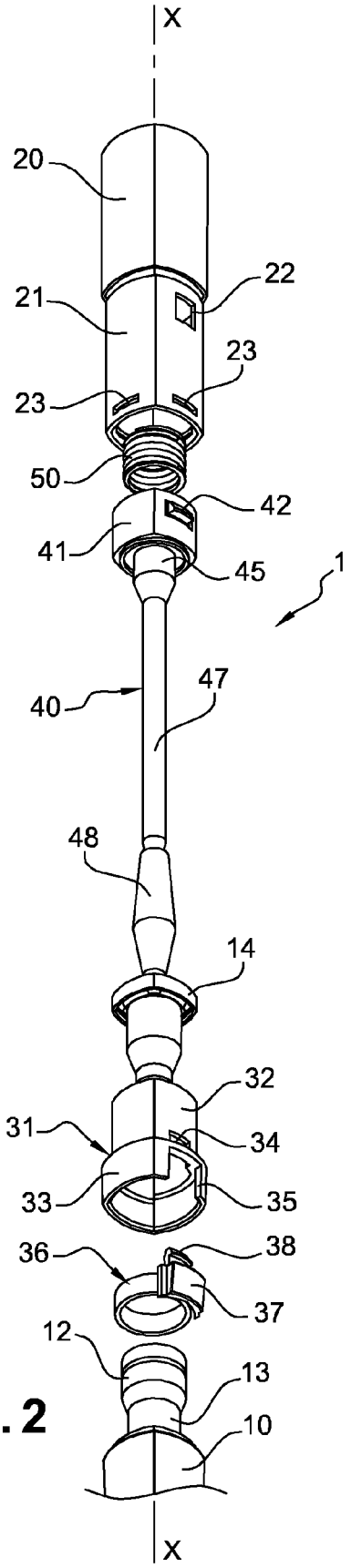
FIG. 2 shows an exploded view of the device from FIG. 1.

With reference to FIGS. 1 and 2, a device 1 for packaging a cosmetic product comprises a container 10 for containing said product, a cap 20 for closing the container 10 and a locking mechanism 30 for keeping the cap 20 on the container 10.

In this example, the device 1 is a device for packaging and applying mascara, but the invention is not limited to this type of packaging. The invention may also relate to devices for packaging other cosmetic products such as nail varnishes, lipsticks, lip glosses or care products, for example.

The container 10, the locking mechanism 30 and the cap 20 of the device 1 have non-circular cross sections, which are in particular approximately square in this example. However, other cross sections of the device 1 are conceivable, such as polygonal, ovoid, circular or other cross sections.

The container 10 is a hollow body that extends mainly along a longitudinal axis X-X, is closed at one end by an end wall, and is open at the other end. The opening in the container 10 is defined by a neck 12 that extends from a shoulder of the container 10. In this example, the neck 12 has a circular cross section, but it could have a different one.

The neck 12 may have a narrowing 13 located between the container and the upper rim of the neck 12.

The container 10 may for example be made of glass, metal or plastic.

A seal 14 is fixed in the opening defined by the neck 12 of the container 10. In the case of mascara, the seal 14 also provides the function of wiping an applicator 40, which will be described hereinbelow. To this end, the seal may also be called a wiper.

The seal 14 is approximately tubular and is engaged with a tight fit against the inner wall of the neck 12 so as to form cylindrical impermeability between the seal 14 and the neck 12 of the container 10. The seal 14 may comprise an upper edge intended to come into axial contact with the upper peripheral rim of the neck 12.

In addition, the seal 14 may comprise, close to its upper end, an external annular boss which is engaged in an internal annular groove in the neck 12 in order to axially retain the seal 14 in the neck 12.

In order to provide the wiping function, the lower end of the seal 14 is formed with a frustoconical wall which is flared from bottom to top so as to define a through-orifice towards the inside of the container, said orifice being narrower than the opening in the neck 12.

The mechanism 30 for locking the cap 20 on the container 10 comprises a hoop 31 and an elastic ring 36 which are fitted around the neck 12 of the container 10. The hoop 31 of the locking mechanism 30 is fixed to the neck of the container 10, keeping the ring 36 around the neck 12.

The hoop 31 comprises an upper part 32 and a lower part 33. The upper part 32 is fixed on the neck 12 in a non-removable manner. To this end, the inner wall of the upper part 32 of the hoop 31 is fitted tightly to the outer wall of the neck 12. The upper part 32 of the hoop 31 may be fixed to the neck 12 by any appropriate means, for example by adhesive bonding, with a tight fit or by snap-fastening.

A bottom portion of the upper part 32 of the hoop 31 comprises a window 34 that opens out next to the top portion of the narrowing 13 of the neck 12. This bottom portion of the upper part 32 of the neck 31 is thus not in contact with the outer wall of the neck 12.

The cross section of the upper part 32 of the hoop 31 is narrower than the upper cross section of the body 10 of the container at the shoulder between the body of the container 10 and the neck 12.

The cross section of the upper part 32 of the hoop 31 is non-circular, and is in particular approximately square. However, other cross sections of the upper part 32 of the hoop 31 are conceivable, such as polygonal, ovoid, circular or other cross sections. The cross section of the upper part 32 of the hoop 31 does not have to be homothetic with respect to the cross section of the body of the container 10.

When the upper part 32 of the hoop is fixed in position on the neck 12, the lower peripheral edge of the lower part 33 of the hoop 31 is positioned against or substantially against the shoulder between the neck 12 and the body of the container 10.

The lower part 33 of the hoop 31 is connected to the upper part 32 by a shoulder such that the cross section of the lower part 33 is wider than the cross section of the upper part 32. In particular, the cross section of the lower part 33 may be matched to the cross section of the container 10 in order to continue the surface of the container 10.

The inner wall of the lower part 33 of the hoop 31 is positioned facing the narrowing 13 of the neck 12 so as to form an approximately annular space 39 between the lower part 33 of the hoop 31 and the neck 12 of the container 10.

The lower part 33 of the hoop 31 comprises an opening 35 that opens into the approximately annular space 39.

The elastic ring 36 is positioned in the annular space 39 around the neck 12 and facing the narrowing 13.

This ring 36 is produced from elastic metal or of elastic plastic, such as polyoxymethylene (POM) or acrylonitrile butadiene styrene (ABS), for example.

The elastic ring 36 forms an annulus having an inside diameter greater than the outside diameter of the narrowing 13, and having an outside diameter greater than the diameter of the inner wall of the lower part 33 of the hoop 31. Thus, the elastic ring 36 is mounted prestressed in the hoop 31. This prestressed position of the ring 36 is called the rest position of said ring 36.

The elastic ring 36 comprises an actuating means 37, such as a push button, placed in the opening 35 in the hoop 31. In the rest position of the ring 36, the actuating means 37 may project from the wall of the lower part 33 of the hoop 31.

The elastic ring 36 also comprises a retaining means 38. This retaining means 38 is intended to lock the cap 20 on the container 10 as will be described hereinbelow.

The retaining means 38 forms for example a catch positioned in the window 34 in the bottom portion of the upper part 32 of the hoop 31. In the rest position of the ring 36, the retaining means 38 projects from the wall of the upper part 32 of the hoop 31.

The retaining means 38 is positioned on the same side of the ring as the actuating means 37. The catch is, for example, positioned at the end of a tab which is connected at its other end to the ring 36 and to the actuating member 37.

When the user exerts a pressure on the actuating means 37, the ring 36 is deformed and the actuating means 37 is moved towards the neck 12 along with the retaining means 38, such that the retaining means 38 no longer projects from the window 34. The actuating means 37 is thus able to move radially with respect to the container 10.

When the pressure on the actuating means 37 is released, the elastic ring 36 returns to its rest position.

In this example, the actuating means 37 and the retaining means 38 are connected to an elastic ring, although it is possible for them not to be connected to the elastic ring. Similarly, this example describes an elastic ring, but any other elastic return member may be used. Moreover, the means for actuating the retaining means is not limited to a push button; it may also be a lever, a sliding member, or the like.

The cap 20 of the device 1 is a hollow body that extends mainly along the longitudinal axis X-X of the container 10, is closed at one end by an end wall and is open at the other end so that it can be positioned around the neck 12 of the container 10. For this purpose, the height of the cap 20 is greater than the height of the neck 12.

The cap may be produced from metal, glass, plastic or any other material.

An insert 21 is fixed in a non-removable manner in the cap 20. The insert 21 is a tubular hollow body fitted into the cap 20. In this example, the cross section of the insert 21 is approximately square, but this cross section may have any other shape, depending on the cross section of the cap 20.

The insert 21 may be fixed in a non-removable manner in the cap 20 by any appropriate means, for example by adhesive bonding, with a tight fit or by snap-fastening.

The lower part of the insert 21, that is to say the part closest to the open end of the cap 20, comprises an opening that opens at least onto the inner wall of the insert 21. This opening defines a catching means 23 for the means 38 for retaining the locking mechanism 30. In this example, each side of the tubular insert 21 having a square cross section has such a catching means 23, such that, whatever the angular position of the cap 20 with respect to the container, at least one catching means 23 is located facing the means 38 for retaining the locking mechanism 30.

Two mutually opposing walls of the upper part of the insert 21 each comprise a window 22 that opens at least onto the inner wall of the insert 21.

A closing-off element 45 for the opening in the container 10 is mounted in a sliding manner with respect to the insert 21 and thus with respect to the cap 20. To this end, an upper part 41 of the closing-off element 45 forms a solid plate which has a cross section complementary to the internal cross section of the insert 21 such that it can slide in this insert 21.

The upper part 41 of the closing-off element 45 comprises two protrusions 42 that extend radially on either side of the upper part 41 of the closing-off element 45. Each protrusion 42 is inserted into a window 22 in the insert 21 such that it can move in this window 22 along an axis parallel to the axis X-X. Thus, the protrusions 42, which come into abutment against the upper and lower rims of the windows 22 in the insert 21, form a means for limiting the movement path of the cap 20 with respect to the closing-off element 45 when the cap 20 slides with respect to the closing-off element 45.

The closing-off member 45 comprises a cylinder that is positioned in contact with the inner faces of the tubular portion of the seal 14.

Figure 6:
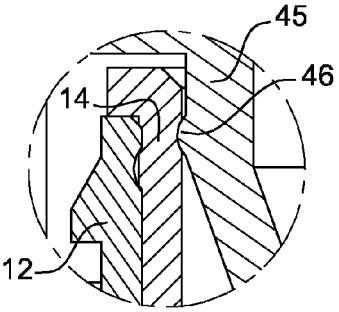
FIGS. 6 and 7 show detail views of an example of a seal according to a first and a second variant.
Figure 7:
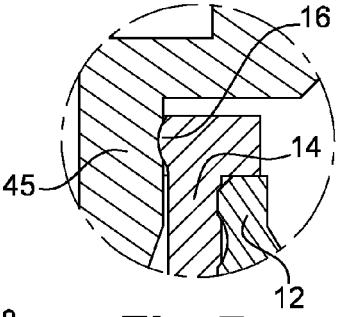

In order to obtain optimum contact to form impermeability at the neck of the container 10, the closing-off element 45 may comprise an annular bead 46 on its periphery, as is shown in FIG. 6. A variant is shown in FIG. 7, in which the closing-off element 45 does not have a bead but in which the inner face of the seal 14 has an annular bulge 16 that deforms in contact with the closing-off element 45. In any case, contact between each element that forms impermeability takes place radially with respect to the longitudinal axis X-X.

The impermeability thus obtained is impermeability to gas and to liquid. More precisely, the device remains impermeable, that is to say that no leakage of product to the outside of the device is observable, when the device is placed in the locked position in a vacuum bell in order to be subjected to reduced pressure while the pressure inside the container 10 containing cosmetic product, such as mascara, is approximately equal to the atmospheric pressure of around 1 bar. The impermeability of the device is preserved down to a pressure in the bell, outside the device, of less than 0.3 bar, or even less than 0.25 bar, for example 0.2 bar.

Moreover, in the unlocked position, the device remains impermeable at atmospheric pressure as long as the closing-off element 45 is not removed from the neck of the container 10. The force for removing the closing-off element 45 from the neck of the container 10 is greater than the weight of the container 10 filled with product P. For example, this removing force is greater than 1 Newton or even greater than 2 Newtons.

In this example, a wand 47 extends longitudinally along the axis X-X starting from the closing-off element 45. The end of the wand 47 is provided with an applicator element 48 for example of the mascara brush type. Thus, when the closing-off element 45 closes the opening in the container 10, the wand 47 and the applicator element 48 are dipped into the container 10. The cap 20 and the closing-off element 45 thus form a cosmetic product applicator 40.

The device 1 comprises a spring member 50 located between the cap 20 and the upper part 41 of the closing-off element 45 so as to generate a force that tends to push these two elements away from one another along the longitudinal axis X-X. The spring member 50 may be a helical spring mounted in compression between the cap 20 and the upper part 41 of the closing-off element 45. However, other types of spring element may be used, for example elastic tongues formed integrally with the closing-off element 45 or with the insert 21.

The manner in which the device 1 functions will now be described with reference to FIGS. 3 to 5.

Figure 3:
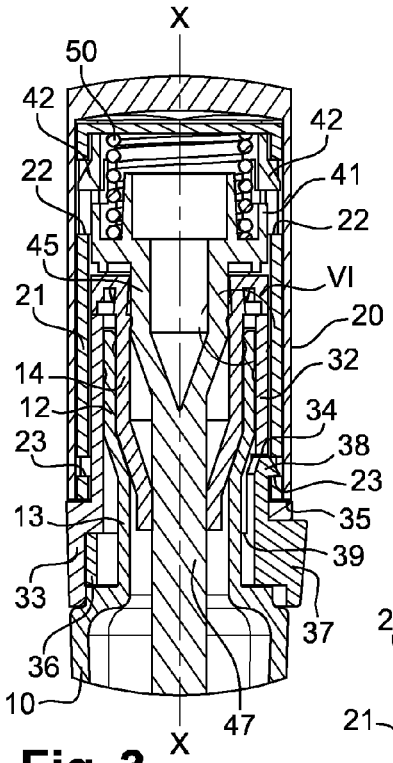
FIGS. 3 to 5 show sectional views of the cap of the device from FIG. 1, in the locked position, the unlocked position and removed position, respectively.

With reference to FIG. 3, the cap 20 of the device 1 is in the locked position on the container 10.

In this locked position, the closing-off element 45 is positioned in the opening in the container 10 so as to be in contact with the seal 14. The upper part 41 of the closing-off element 45 may come into axial abutment against the upper peripheral rim of the neck 12. The elastic ring 36 is in its rest position and the retaining means 38 is projecting from the outside of the hoop 33 so as to be engaged with a catching means 23 of the insert 21. The spring 50 is thus compressed between the cap 20 and the closing-off element 45, the cap 20 then being held axially by the locking mechanism 30.

Figure 4:
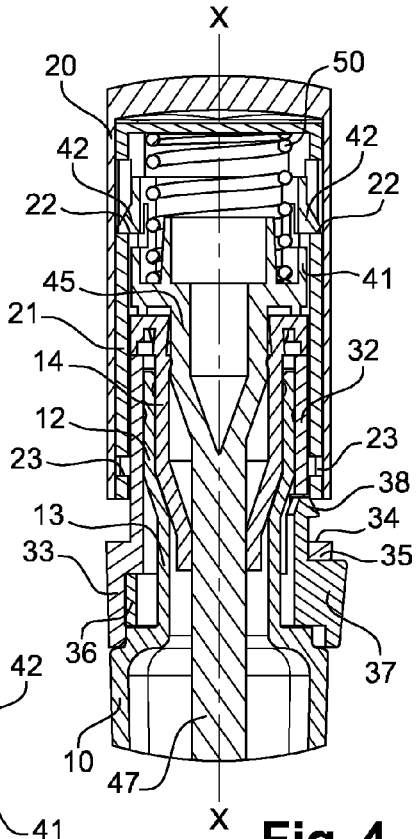

With reference to FIG. 4, the cap 20 of the device 1 is in a predetermined unlocked position.

In order to achieve this position, the user exerts a pressure on the means 37 for actuating the retaining means 38 in order to inactivate the retaining means 38 so as to enable the cap 20 to move purely in translation with respect to the container 10 under the effect of the at least partial expansion of the compressed spring 50. The cap 20 moves from its locked position towards an unlocked position in which the cap 20 can be separated freely from the container. During this movement, the closing-off element 45 remains in position in the opening in the container and also in the unlocked position in which the radial contact between the seal 14 and the closing-off element 45 is preserved, making it possible to maintain impermeability even in the unlocked position.

The unlocked position is determined by the travel limiter when the lower rim of the window 22 in the insert 21 is in axial abutment against the protrusion 42 on the upper part 41 of the closing-off element 45.

Figure 5:
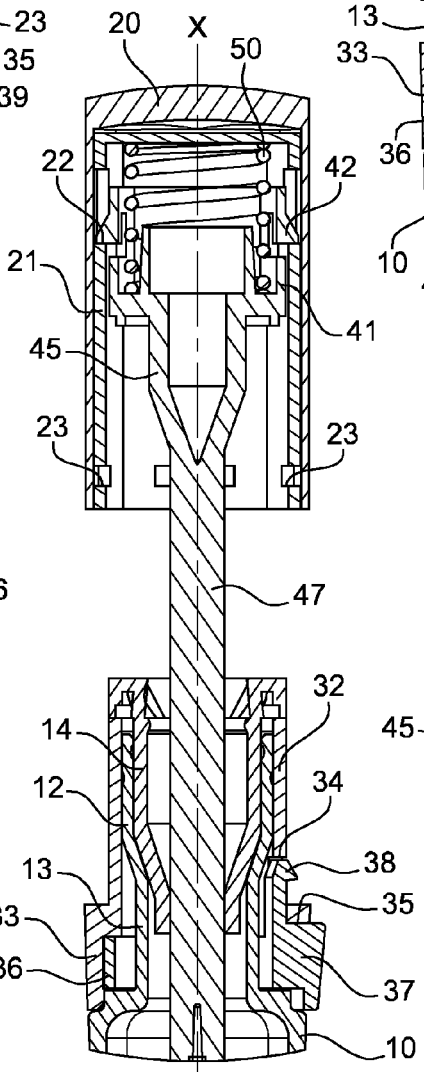

The user can then remove the cap 20 by exerting an axial pulling force greater than the frictional force exerted by the closing-off element 45 on the seal 14, as is shown in FIG. 5.

Figure 8:
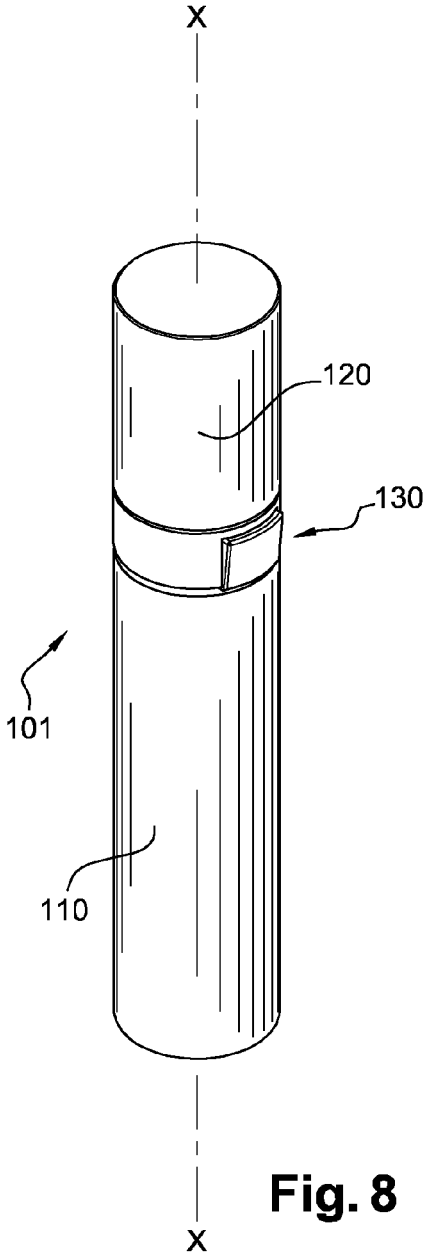
FIG. 8 shows a variant of the packaging device from FIG. 1.
Figure 9:
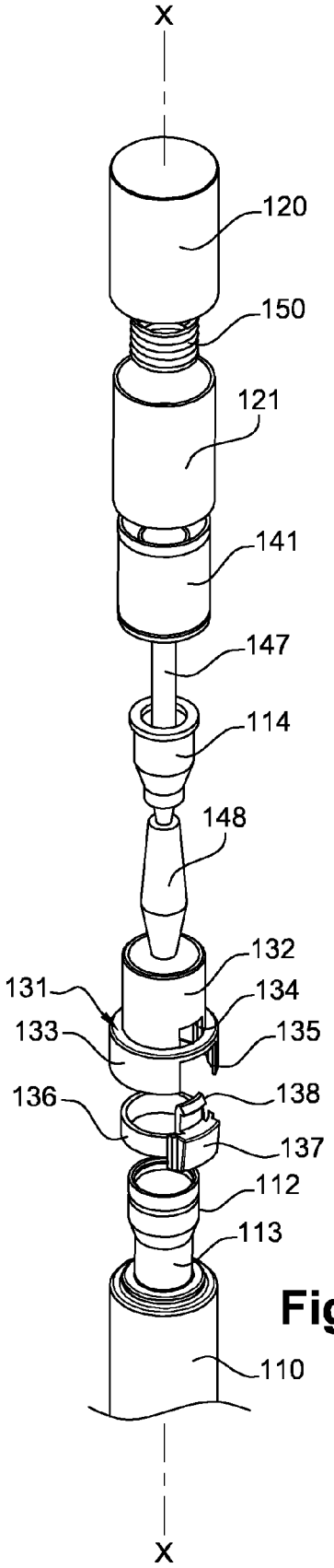
FIG. 9 shows an exploded view of the device from FIG. 8.

A variant of the above-described device is shown in FIGS. 8 and 9.

This variant provides a device 101 for packaging and applying mascara.

The device 101 comprises a container 110, a locking mechanism 130 and a cap 120. In this variant, the cross sections of the container 110, of the locking mechanism 130 and of the cap 120 are circular. However, other cross sections of the device 101 are conceivable, such as polygonal, ovoid, non-circular or other cross sections.

As in the above-described device 1, the container 110 in this variant is a hollow body that extends mainly along a longitudinal axis X-X, is closed at one end by an end wall, and is open at the other end. The opening in the container 110 is defined by a neck 112 that extends from a shoulder of the container 110.

The neck 112 may likewise have a narrowing 113 located between the container and the upper rim of the neck 112.

A seal 114 is fixed in the opening defined by the neck 112 of the container 110. The seal 114 is likewise of the above-described wiper type.

The mechanism 130 for locking the cap 120 on the container 110 likewise comprises a hoop 131 and an elastic ring 136 which are fitted on the neck 112 of the container 110.

Unlike the above-described device, the cross section of the upper part 132 of the hoop 131 is circular.

The elastic ring 136 comprises an actuating means 137, such as a push button, placed in an opening 135 in the hoop 131.

The elastic ring 136 likewise comprises a retaining means 138 intended to lock the cap 120 on the container 110.

The retaining means 138 forms a catch positioned in a window 134 in a bottom portion of the upper part 132 of the hoop 131.

An insert 121 is fixed in a non-removable manner in the cap 120. The insert 121 is a tubular hollow body fitted into the cap 20. In this variant, the cross section of the insert 121 is circular.

The insert 121 may be fixed in a non-removable manner in the cap 120 by any appropriate means, for example by adhesive bonding, with a tight fit or by snap-fastening.

The lower edge of the insert 121, that is to say the edge closest to the open end of the cap 120, comprises a projection 142 that extends radially from the wall of the insert 121 towards the inside of the insert 121. This projection 142 defines a catching means for the means 138 for retaining the locking mechanism 130.

Since this projection 145 extends around the entire circular perimeter of the lower edge of the insert 121, it makes it possible advantageously to define a non-indexed catching means, that is to say that the cap 120 may be connected to the container 110 with any relative angular orientation between the cap 120 and the container 110.

A closing-off element 145 for the opening in the container 110 is mounted in a sliding manner with respect to the insert 121. To this end, an upper part 141 of the closing-off element 145 comprises a cylindrical outer wall complementary to the internal cross section of the insert 121 such that it can slide in this insert 121.

The projection 142 on the insert 121 forms a stop against which the lower edge of the cylindrical upper part 141 of the closing-off element 145 can come into axial abutment so as to form a means for limiting the movement path of the cap 120 with respect to the closing-off element 145.

The closing-off element 145 ensures the impermeability of the device 101 in the same way as the above-described device 1.

Similarly, a wand 147 extends longitudinally along the axis X-X from the closing-off element 145, the end of said wand 147 being provided with an applicator element 148.

Finally, the device 101 likewise comprises a spring member 150 located between the cap 120 and the upper part 141 of the closing-off element 145 so as to generate a force that tends to push these two elements away from one another.

The manner in which the device 101 functions will now be described with reference to FIGS. 10 to 12.

Figure 10:
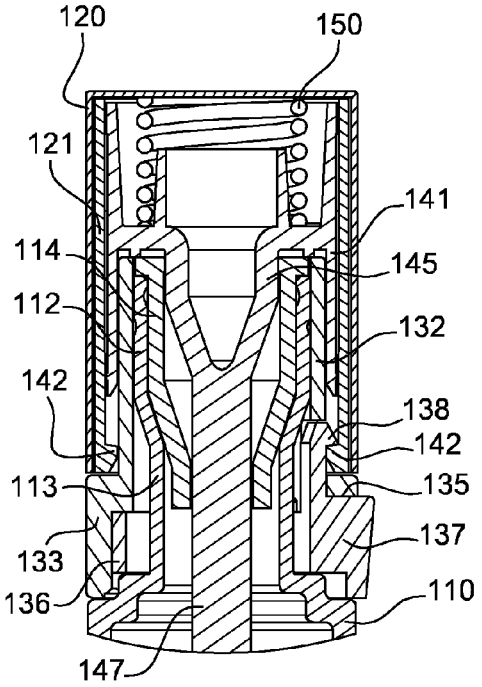
FIGS. 10 to 12 show sectional views of the cap of the device from FIG. 8, in the locked position, the unlocked position and removed position, respectively.

With reference to FIG. 10, the cap 120 of the device 101 is in the locked position on the container 110.

In this locked position, the closing-off element 145 is positioned in the opening in the container 110 so as to be in contact with the seal 114. The upper part 141 of the closing-off element 145 may come into axial abutment against the upper peripheral rim of the neck 112. The elastic ring 136 is in its rest position and the retaining means 138 is projecting from the outside of the hoop 133 so as to be engaged in a catching means 142 formed by the projection of the insert 121. The spring 150 is thus compressed between the cap 120 and the closing-off element 145, the cap 120 then being held axially by the locking mechanism 130.

Figure 11:
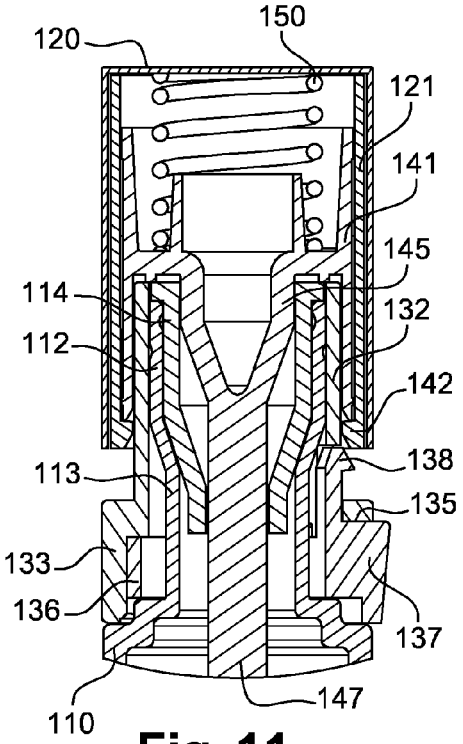

With reference to FIG. 11, the cap 120 of the device 1 is in a predetermined unlocked position.

In order to achieve this position, the user exerts a pressure on the means 137 for actuating the retaining means 138 in order to inactivate the retaining means 138 so as to enable the cap 120 to move purely in translation with respect to the container 110. As in the above-described device, during this movement, the closing-off element 145 remains in position in the opening in the container in order to maintain impermeability even in the unlocked position.

The unlocked position is determined by the travel limiter when the projection 142 on the insert 21 is in axial abutment against a portion of the upper part 141 of the closing-off element 145.

Figure 12:
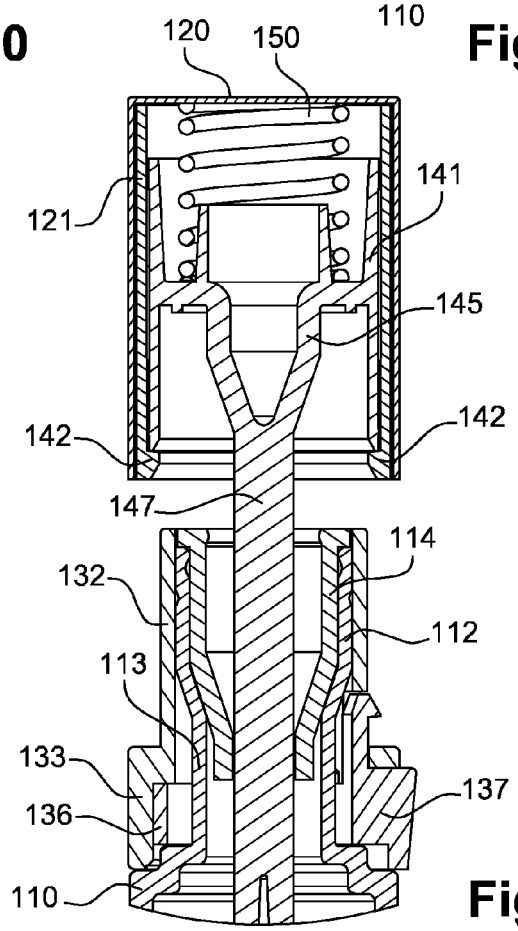

The user can then remove the cap 120 by exerting an axial pulling force greater than the frictional force exerted by the closing-off element 145 on the seal 114, as is shown in FIG. 12.

Variants of elastic rings and hoops for locking mechanisms of devices according to the invention are shown in FIGS. 13 to 18.

Figure 13:
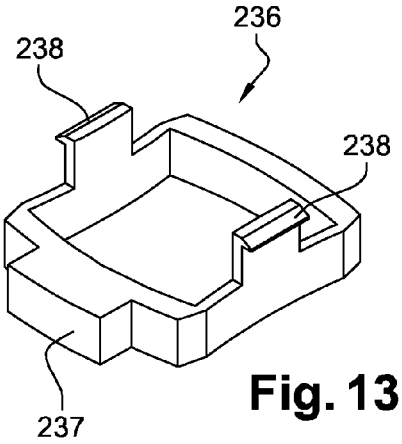
FIGS. 13 to 18 show variants of rings of the locking mechanism of a device of the invention, on their own and fitted in said mechanism.
Figure 14:
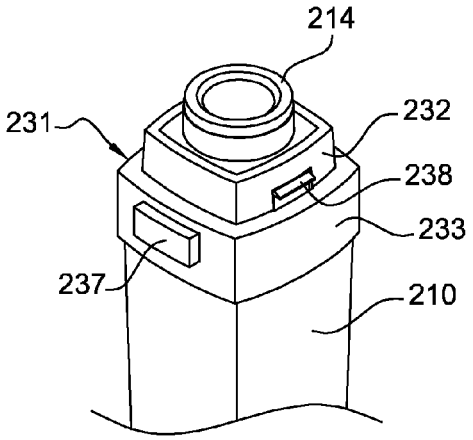

A first variant of an elastic ring 236 is shown in FIG. 13 and the mounting thereof in a corresponding hoop 231 on the container 210 is shown in FIG. 14.

The elastic ring 236 has an approximately square shape. A first section forming a side of the square ring 236 has an actuating means 237 which is in the form of a push button.

Two lateral sections connect a second, opposite section to the first section of the ring 236. The lateral sections are curved towards the inside of the ring 236 and each has in its middle a retaining means 238 of the locking mechanism. Thus, a pressure on the actuating means 237 tending to bring the first section and the second section towards one another causes the retaining means 238 to move towards the inside of the elastic ring 236.

The hoop 231 thus has two lateral windows 232 for the retaining means 238 to pass through.

Figure 15:
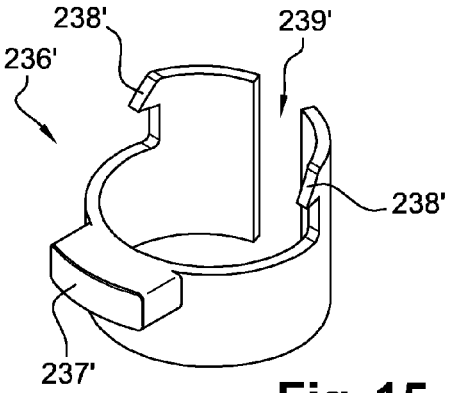
Figure 16:
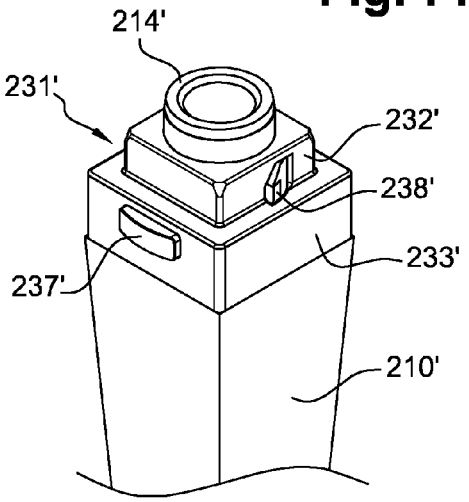

A second variant of an elastic ring 236' is shown in FIG. 15 and the mounting thereof in a corresponding hoop 231' on the container 210' is shown in FIG. 16.

The elastic ring 236' has an approximately circular shape and has an actuating means 237' which is in the form of a push button.

The ring 236' has a slot 239' positioned opposite the actuating means 237' such that the ring 236' does not form a closed annulus. Thus, two circular lateral sections extend from the actuating means 237' as far as a free end at the slot 239'.

Each section has a retaining means 238' forming a catch that extends approximately tangentially to the circular ring.

A pressure on the actuating means 237' causes the free ends of the sections to move towards one another, thereby reducing the width of the slot 239'. Consequently, the retaining means 238' move towards the inside of the elastic ring 236' and in the direction of the slot 239'.

The hoop 231' then comprises two lateral windows 232' for the retaining means 238' to pass through and for them to slide towards the inside of the hoop 231'.

Figure 17:
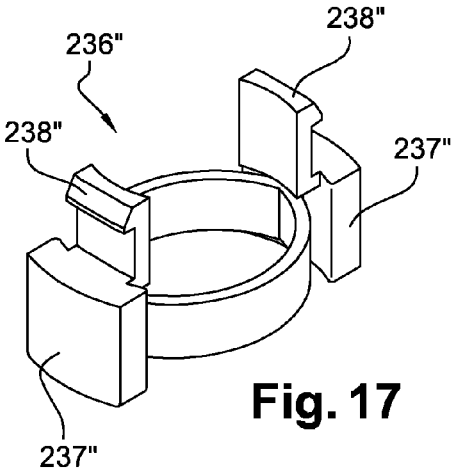
Figure 18:
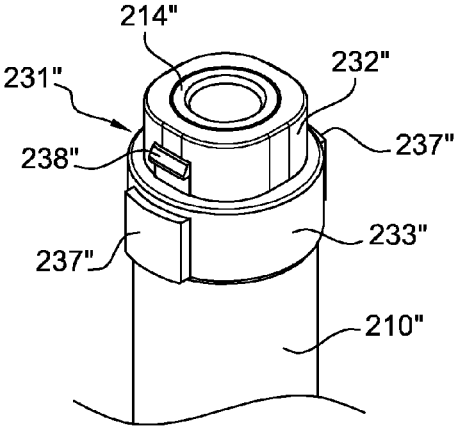

A third variant of an elastic ring 236" is shown in FIG. 17 and the mounting thereof in a corresponding hoop 231" on the container 210" is shown in FIG. 18.

The elastic ring 236" has an approximately circular shape and has two actuating means 237" in the form of a push button, said actuating means 237" being positioned on either side of the ring 236".

Each actuating means 237" is connected to a retaining means 238" in the form of a catch that extends axially from each actuating means 237".

Thus, simultaneous pressure on the actuating means 237" causes the actuating means to move towards one another towards the centre of the ring 236" and also causes the retaining means 238" to move towards one another towards the inside of the elastic ring 236".

The hoop 231" then comprises two opposite windows 232" for the retaining means 238" to pass through, and two opposite openings for the actuating means 237" to pass through.

Figure 19:
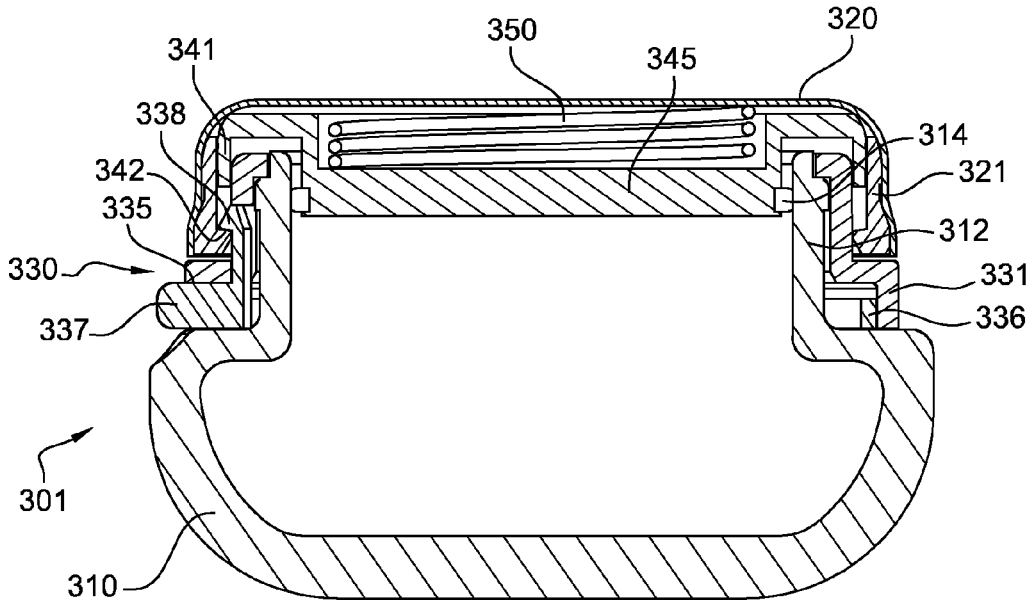
FIGS. 19 and 20 show another variant of a packaging device according to the invention.
Figure 20:
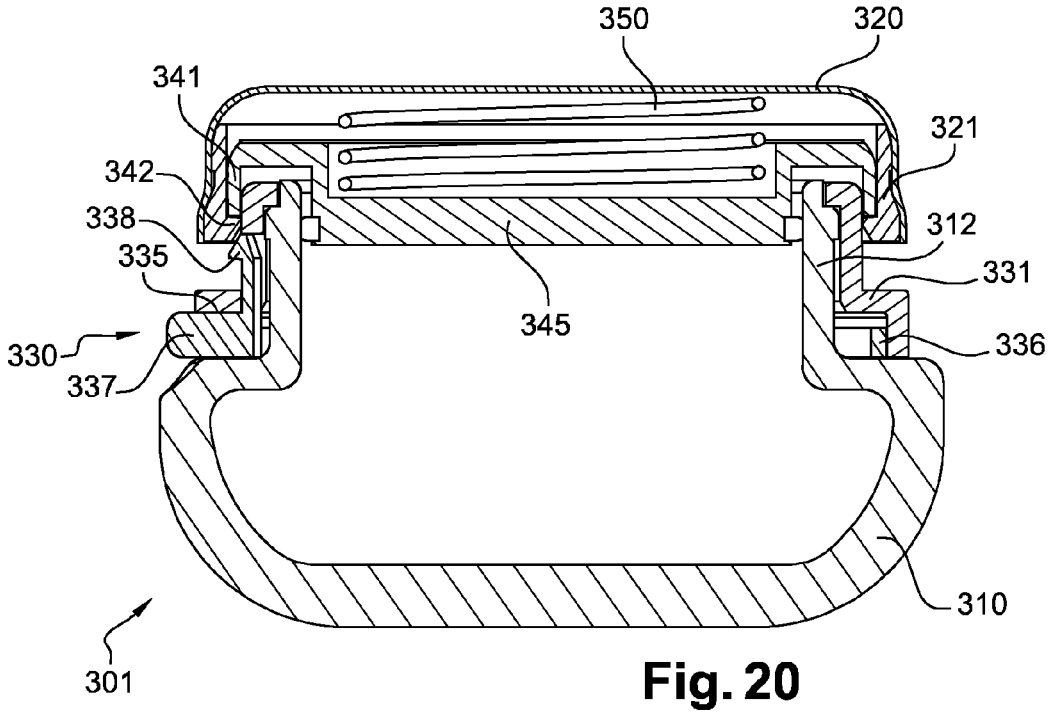

A variant of the device of the invention is shown in FIGS. 19 and 20.

This variant provides a device 301 for packaging a care product such as a cream.

The device 301 comprises a container 310, a locking mechanism 330 and a cap 320. In this variant, the container 310 is in the form of a pot.

The container 310 of this variant is a hollow body closed at one end by an end wall, and comprising, at the other end, an opening, which in this example is circular, defined by a neck 312 that extends from a shoulder of the container 310.

As in the preceding variants of devices, the mechanism 330 for locking the cap 320 on the container 310 comprises a hoop 331 and an elastic ring 336 which are fitted on the neck 312 of the container 310.

The elastic ring 336 comprises an actuating means 337, such as a push button, placed in an opening 335 in the hoop 331. The elastic ring 336 likewise comprises a retaining means 338 intended to lock the cap 320 on the container 310.

An insert 321 is fixed in a non-removable manner in the cap 320. The insert 321 is a tubular hollow body fitted into the cap 320.

The lower edge of the insert 321 comprises a projection 342 that extends radially from the wall of the insert 321 towards the inside of the insert 321. This projection 342 defines a catching means for the means 338 for retaining the locking mechanism 330.

A closing-off element 345 for the opening in the container 310 is mounted in a sliding manner with respect to the insert 321. To this end, an upper part 341 of the closing-off element 345 comprises a cylindrical outer wall complementary to the internal cross section of the insert 321 such that it can slide in this insert 321.

The lower part of the closing-off element 345 forms a plate which has a circular cross section and can be inserted into the opening formed by the neck 312 of the container 310.

The edge of the plate of the closing-off element 345 has a seal 314 which is fixed in a peripheral groove in the plate. Thus, the closing-off element 345 and its seal 314 are suitable for closing the opening in the container 310 in an impermeable manner.

The projection 342 on the insert 321 forms a stop against which the lower edge of the cylindrical upper part 341 of the closing-off element 345 can come into axial abutment so as to form a means for limiting the movement path of the cap 320 with respect to the closing-off element 345.

Finally, the device 301 likewise comprises a spring member 350 located between the cap 320 and the upper part 341 of the closing-off element 345 so as to generate a force that tends to push these two elements away from one another.

The way in which this variant functions is similar to the way in which the above-described variants of the device function.

The invention is not limited to the examples illustrated. The features of the various examples can in particular be combined as part of variants which are not illustrated.

The expression "comprising a" should be understood as meaning "comprising at least one", unless specified to the contrary.

The invention claimed is:

1. A device for packaging a cosmetic product, comprising:

a container having an opening defined by a neck of the container;

a cap for closing the container;

a closing-off element for the opening, the closing-off element connected to the cap;

a spring member located between the cap and the closing-off element;

a seal configured to engage with the closing-off element and the neck of the container; and a locking mechanism for locking the cap on the container in a locked position, the locking mechanism fixed to the container;

wherein the locking mechanism comprises a retaining means and an actuating means for actuating the retaining means to inactivate the retaining means so as to enable the cap to be moved from the locked position to an unlocked position in which the cap can be separated freely from the container.

2. The device according to claim 1, wherein the cap is moved from the locked position to the unlocked position by moving solely in translation with respect to the container.

3. The device according to claim 1, wherein the closing-off element is fixed with respect to the container during movement of the cap from the locked position to the unlocked position.

4. The device according to claim 1, wherein the seal is in contact with the closing-off element and the neck of the container in the unlocked position of the cap.

5. The device according to claim 1, wherein contact between the seal and the neck of the container and/or between the seal and the closing-off element is radial with respect to a movement axis of the cap from the locked position to the unlocked position.

6. The device according to claim 1, wherein the seal is fixed relative to the closing-off element.

7. The device according to claim 1, wherein the closing-off element comprises an applicator which extends from the cap into the container, and the seal comprises an applicator wiper mounted in a fixed manner on the neck of the container.

8. The device according to claim 1, wherein an insert is fixed in the cap and the closing-off element is mounted in a sliding manner in the insert.

9. The device according to claim 8, wherein the insert comprises a catching means that engages with the retaining means of the locking mechanism.

10. The device according to claim 8, wherein the insert comprises a travel-limiting means for limiting the movement path of the cap with respect to the closing-off element as the cap passes from the locked position to the unlocked position.

11. The device according to claim 10, wherein the travel-limiting means is formed by the catching means of the insert that engages with a stop of the closing-off member.

12. The device according to claim 10, wherein the travel-limiting means comprises a window in the insert that engages with a protrusion on the closing-off element.

13. The device according to claim 1, wherein the locking mechanism comprises a hoop fixed around the neck of the container and an elastic ring positioned between the hoop and the neck of the container.

14. The device according to claim 13, wherein the retaining means and the actuating means are supported by the elastic ring, and wherein the retaining means and the actuating means project from an outside of the hoop.

15. The device according to claim 13, wherein the neck of the container comprises a narrowed portion to enable a deformation of the ring.

* * * * *